United States Patent [19]

Keyzers et al.

[11] Patent Number: 4,718,157

[45] Date of Patent: Jan. 12, 1988

[54] METHOD AND AN APPARATUS FOR DEBANDING

[75] Inventors: Henricus M. Keyzers; Johannes G. W. Van Ottele, both of Oss, Netherlands

[73] Assignee: Endra B.V., Netherlands

[21] Appl. No.: 834,394

[22] Filed: Feb. 28, 1986

[30] Foreign Application Priority Data

Mar. 4, 1985 [NL] Netherlands ..... 85-00606

[51] Int. Cl.[4] ..... B23P 19/02; B23P 23/00

[52] U.S. Cl. ..... 29/426.4; 29/564.3; 83/100; 83/909

[58] Field of Search ..... 29/564.3, 426.4; 83/909, 924, 100

[56] References Cited

U.S. PATENT DOCUMENTS 4,328,609 5/1982 Born ..... 29/564.3

4,348,801 9/1982 Dumont et al. ..... 83/909 X 4,437,223 3/1984 Petros ..... 29/564.3

4,553,312 11/1985 Mitzel et al. ..... 83/909 X

*Primary Examiner*—Frank T. Yost

*Attorney, Agent, or Firm*—John P. Snyder

[57] ABSTRACT

A method and apparatus for cutting through and removing a strapping element applied in a loop around an object or a stack of objects, in which a plate provided with one cutting member of a pair of shears and a pressure area is first moved parallel to the plane of the loop towards the object or the stack, thereupon moved perpendicularly to said loop until it attains a position between the object and the loop and thereafter moved away from the object to bring said cutting member into cooperation with the other cutting member for cutting through the loop and the pressure area into cooperation with a driven roller for gripping and removing the strapping element of the cut through loop.

10 Claims, 7 Drawing Figures

METHOD AND AN APPARATUS FOR DEBANDING

The invention relates to a method and an apparatus for cutting through and removing a threadlike or tape-like strapping element applied around an object or a stack of objects, said apparatus comprising a processing place, cutting members for cutting through a strapping loop formed by a thread or tape and embracing an object or a stack of objects placed in the processing place and members for the discharge of the thread or tape of the cut through loop, said cutting members as well as said discharge members being provided on a unit which cooperates with a feeler and is mounted for movement towards and from said object or said stack of objects in a direction parallel to the plane of the strapping loop to be cut through on a carrier adapted to be moved along guiding members which extend at right angles to the plane of said strapping loop and are provided outside the processing place.

An apparatus of this kind has been disclosed in the European patent application No. 79.900122.7 published under the number 0014698 (corresponds to U.S. Pat. No. 4,328,609). This known apparatus is provided with a portal, of which the columns are positioned on opposite sides of the processing place and one column guides a carrier with cutting members and the other column guides a carrier with discharge members. The cutting members include a knife with a V-shaped cutting edge mounted for movement along guides which are parallel to the columns of the portal and the discharge members substantially consist of a suction conduit with a funnel-shaped mouth piece connected thereto.

The invention has the object to simplify the cutting and discharge device by using a different method; to adapt said device better for cutting through tape, e.g. tape of synthetic substance reinforced by glass fibre or even metal tape, which is difficult to cut, and to make the certainty of discharge of the thread or tape of the cut through strapping loop greater than when for that purpose only an air flow is used. This different method is substantially characterized in that a separating plate which is mounted for movement towards and from said object or stack of objects in a direction parallel to the plane of the loop of the strapping element to be cut through as well as for movement in a direction at right angles to said plane is so moved together with a member formed on or attached to the separating plate and with a pressure area or a pressure roller, said member being one of two cutting members adapted to cooperate as a pair of shears, between said object or stack of objects and the strapping loop, as to ensure that the strapping element comes to extend across and in contact or nearly in contact with the cutting edge of that cutting member and with said pressure area or said pressure roller, and thereupon the separating plate with accessories is moved away from the object or the stack of objects, as a result of which the one cutting member is moved with its cutting edge past the cutting edge of the other member of the two cooperating cutting members, the strapping loop is cut through and at the same time or slightly later the end portion of the cut through strapping element extending across the pressure area or the pressure roller is clamped between said area or said roller and a conveyor roller which, in the meantime has been driven, so that the strapping element is pulled loose from the object or stack of objects and discharged.

From this method it may be inferred that the cutting members and the discharge members are situated on the same side of the object or the stack of objects to be handled; the strapping element formed into a loop is cut by a pair of shears instead of by a single knife and the discharge of the strapping element, after the loop has been cut through, takes place in a non-slip way. The first fact makes it possible to give the apparatus a simpler and less voluminous construction. Due to the second fact the cutting through of the strapping loop can be effected with a considerable force parallel to the plane of said loop without the exertion of a noticeable force on the strapping element in the direction at right angles to said plane and without the danger of pushing the loop away by said force operating in perpendicular direction on the loop instead of cutting the latter through.

To carry this method out the above described known apparatus has been modified in that the cutting members and the discharge members form parts of one and the same cutting and discharge unit which is adapted to operate on one side of the object or the stack of objects only, said unit comprising a separating plate, a cutting member formed on or attached to said plate and constituting one of two cutting members which are adapted to cooperate as a pair of shears, a pressure area formed on or attached to the separating plate or a pressure roller provided thereon, the other one of said two cutting members and a rotary conveyor roller which is adapted to be driven; the separating plate with that one cutting member and the pressure area or the pressure roller is adapted to be moved between the object or the stack of objects by movement of the carrier; at least the separating plate with accessories on one hand and the remaining parts of the unit on the other hand are so mounted for movement towards and from one another in a direction parallel to the plane of the strapping loop to be cut through, as to enable the two cutting members and also the pressure area or the pressure roller and the conveyor roller to cooperate after having been relatively moved towards each other; and means for the relative movement of the carrier, the cutting and discharge unit and the separating plate and for their movement in respect of the object or the stack of objects occupying the processing place and also means for driving the conveyor roller are provided. This apparatus has only one single carrier with the cutting and discharge unit, so that only one guide column or one set of other guide members is required and the apparatus is placed on one side of the object or the stack of objects to be handled only. Consequently, the apparatus can be used for objects or stacks of objects of any base area, as they need not be transported through a portal.

The means for driving the conveyor roller may include a motor with a stator carried by the cutting and discharge unit and locked against rotation and a rotor mounted on the shaft of the conveyor roller. It is advantageous, when this motor has a rotor adapted to be driven by a gas or air flow. Furthermore, the conveyor roller may be mounted for rotation on a first slide being adapted to be moved towards and from the separating plate and loaded, in the direction towards the separating plate, by, if desired adjustable, spring force which tries to keep the slide pushed against a stop member of said unit. By this construction the pressure with which the discharge members engage the strapping element to be discharged can be adapted to the nature of that element and it is, once adjusted, practically constant.

In order to facilitate the reception of the cut through strapping elements shot away with great velocity from the apparatus, it is recommended to connect the space confined between the pressure area or the pressure roller of the separating plate and the conveyor roller with a passage which is connected to a suction conduit. In that case said suction conduit may advantageously be connected to a venturi-tube operated by pressurized gas or air.

The separating plate of the cutting and discharged unit may have, formed on or contacting its side facing the conveyor roller, a wedge-shaped thickened portion, of which the wedge surfaces meet in or near the free insert edge of the separating plate and enclose in the sectional areas extending at right angles to the separating plate and parallel to the direction of movement of the carrier angles which gradually increase from the side edges of said portion to a place between said side edges. The one of both cutting members which is supported by the separating plate may then be constituted by a flank with a free edge formed as a cutting edge of a recess formed in the wedge surface facing the conveyor roller on one side of the sectional area with the largest wedge angle of said portion, whereas the pressure area or the pressure roller adapted to cooperate with the conveyor roller may then be provided in the last mentioned wedge surface on the other side of said sectional area.

Furthermore, the separating plate may be attached to a second slide which is mounted for movement towards and from the object or the stack of objects placed in the processing place and a feeler for the determination of the stroke of said slide may be provided, said feeler being adapted to be so moved in respect of the separating plate, as to ensure that the stroke of the slide determined by the feeler is adjustable and can be made greater than necessary for bringing the separating plate into contact with the object or one of the objects of the stack. The advantage thereof is that the separating plate pushes the object or an object of the stack slightly away or slightly dents the limp packing of the object in question, so that distance is created between the object and the embracing strapping element to be cut through and discharged, whereby the insertion of the separating plate with accessories between said object and said element is facilitated and the risk of pushing the strapping element away by the separating plate is considerably reduced.

The invention will be further elucidated in the next description with the aid of the accompanying drawing. In this drawing.

Figure 1:
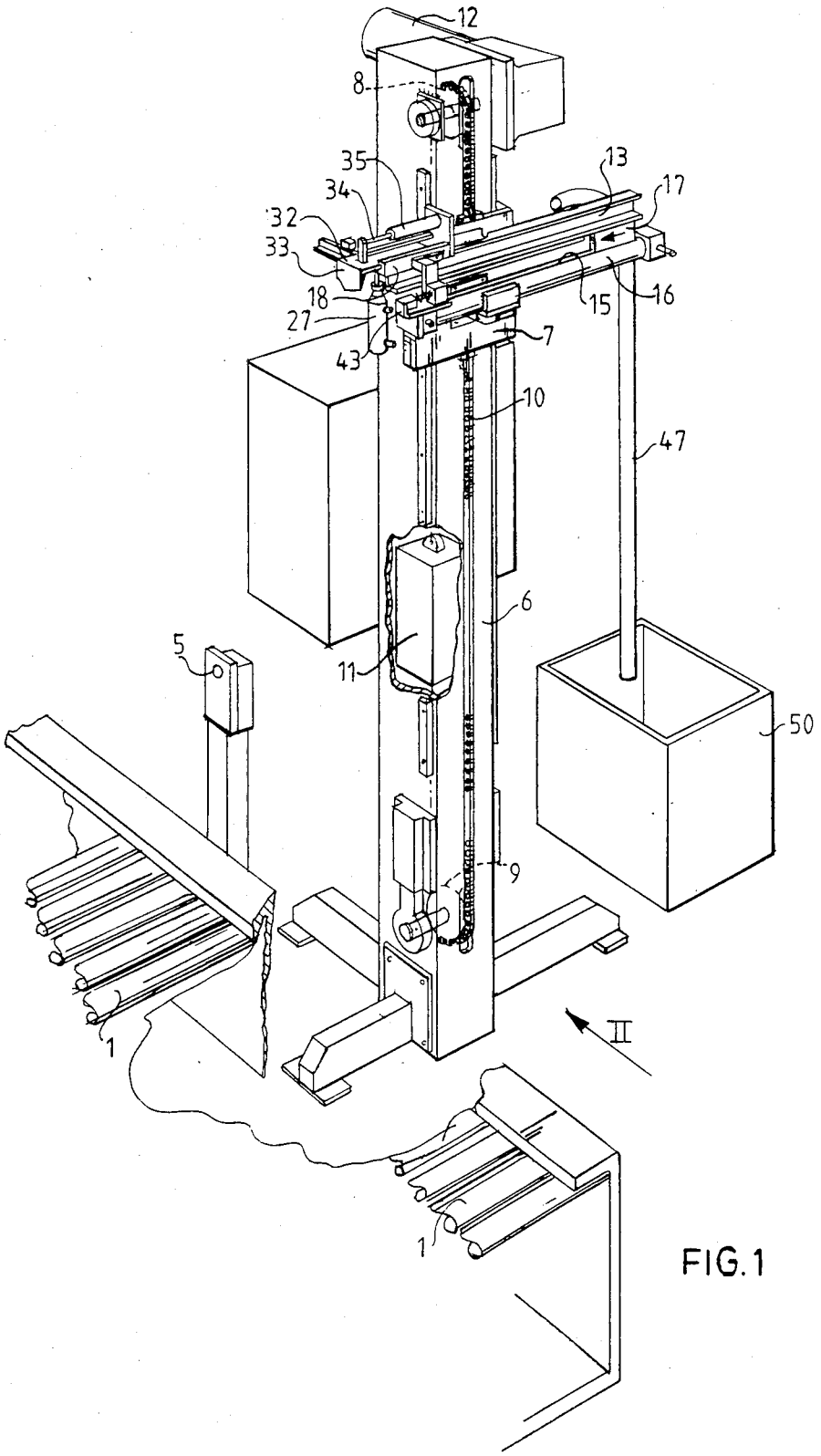
FIG. 1 shows an apparatus according to the invention in perspective.
Figure 2:
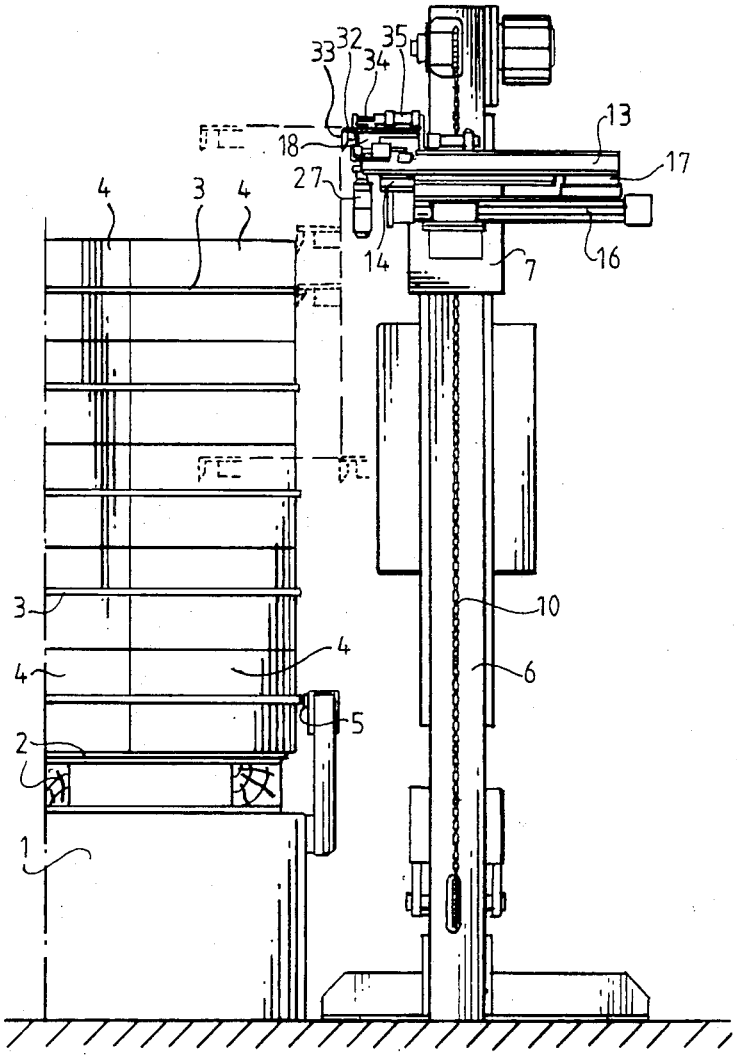
FIG. 2 is an elevational view of said apparatus, seen in the direction of arrow II in FIG. 1.

In FIGS. 1 and 2 a conveyor track with rollers is designated by 1. Pallets 2 with stacks of objects 4, said stacks being embraced by strapping tape 3, are transported on said conveyor track past a vertically mounted apparatus according to the invention for cutting through and discharging strapping tape or thread. This cutting and discharge apparatus is erected on one side of the conveyor track 1. For cutting through the straps embracing the shown stack of objects each time a pallet carrying such a stack comes to a standstill at the side of the cutting and discharge apparatus. The loaded pallet is then in the processing place. A photocell 5 ensures that the pallet comes to a standstill in the right place.

The cutting and discharge apparatus comprises a vertical column 6, along which a carrier 7 provided with the cutting and discharge unit can be moved up and down. For its movement the carrier 7 is attached to a chain 10 led over sprocket wheels 8,9. The ends of said chain are secured to a counter weight 11. The sprocket wheel 8 is coupled with a motor 12 adapted to rotate in two directions for adjusting the carrier with acessories higher or lower. As soon as the stack of objects has arrived at the processing place at the side of the tape cutting and discharge apparatus the height of the carrier is so adjusted in respect of the height of the stack or, when there is more than one strapping tape in respect of the height of the tape to be cut through, by a nonvisible photocell mounted on the carrier 7, as to ensure that a horizontally movable cutting and discharge unit carried by the carrier 7 which then is moved towards the stack comes into contact with the stack in a place above the tape to be cut through.

For its horizontal movement the cutting and discharge unit is attached to a horizontal arm 13 which is mounted for sliding in a guide block 14 of the carrier 7 and is connected at its right hand end to the pneumatically driven piston or other movable member contained in the cylinder 16 of a cylinder motor having a rodless piston by means of a connecting strip 17 extending through a longitudinal slot 15 formed in the wall of said cylinder which is mounted on the carrier 7.

The cutting and discharge unit shown in FIGS. 3–7 comprises a housing 18 attached to the left hand of the arm 13, in which a first slide 20 loaded to the left by adjustable springs 19 and adapted to move in respect of the housing 18 over a short distance in the horizontal direction of movement of the arm 13 with the cutting and discharge unit is accomodated. This slide 20 carries, supported by ball bearings, a vertical rotatable shaft 22, on which a conveyor roller 23 is mounted. The shaft 22 extends through slotted holes 24,25 formed in the housing 18 and is coupled at its lower end with the rotor of a pneumatic motor 27 by means of a connecting bushing 26. This motor is supported by a supporting piece 28 which engages a groove 29 of the housing 18 and is mounted thereon for sliding by a screw stud 31 extending through a slotted hole 30 of the supporting piece 28. The slide 20 is pushed with the shaft 22 against the left hand end of the slotted hole 25, of which said left hand end acts as a stop member.

The housing 18 contains a second slide 32 which is also adapted to be moved in the direction of movement of the arm 13 with accessories and supports at its left hand end projecting from the housing 18 a downwards pointing vertical separating plate 33. For its movement in respect of the housing 18 the slide 32 is coupled with the left hand end of the piston rod 34 of a piston movably contained in a, for instance, double acting pneumatic cylinder 35, which is attached to the housing 18. On its side facing the housing 18 the separating plate 32 is thickened in a wedgelike way. The wedge surfaces of said wedgelike thickening meet in the free lower edge 36 of the separating plate 33 and said thickening has such a shape that the vertical sectional areas extending at right angles to the separating plate 33 enclose from the side edges of said plate to a place between said edges gradually increasing angles. In the last mentioned place the height of the separating plate 33 is somewhat greater than that of the side edges thereof, so that the lower edge 36 of said plate has an insert point.

The wedge surface of the separating plate 33 facing the housing 18 has a recess 37 with an edge 38 (FIGS. 4–7) forming the cutting edge of a shearing member. Said wedge surface has also a pressure area 39 adapted to cooperate with the conveyor roller 23. The cutting edge 38 can cooperate, as in a pair of shears, with the cutting edge of a second cutting member 40 attached to the housing 18.

The slide 32 carries also a pneumatic switch 41 provided with two through going passages which are interconnected in the housing of said switch and connected between the right chamber of cylinder 35 and a suction conduit (not shown) of a pneumatic circuit. If said passages are closed at the lefthand end of the switch housing by a tape to be cut through, the interconnection of the two passages becomes effective and the right hand chamber of cylinder 35 is brought into communication with said suction conduit, so that the slide 32 is drawn to the right, that means towards the housing 18 of the cutting and discharge apparatus. Normally, the right hand chamber of cylinder 35 is connected with a pressure conduit (not shown), as a result of which the slide 32 with the separating plate 33 is kept pushed to the left as far as possible in respect of the housing 18. However, as soon as the pneumatic switch 41 becomes active, said chamber is cut off from said pressure conduit and the slide 32 is drawn to the right.

Figure 4:
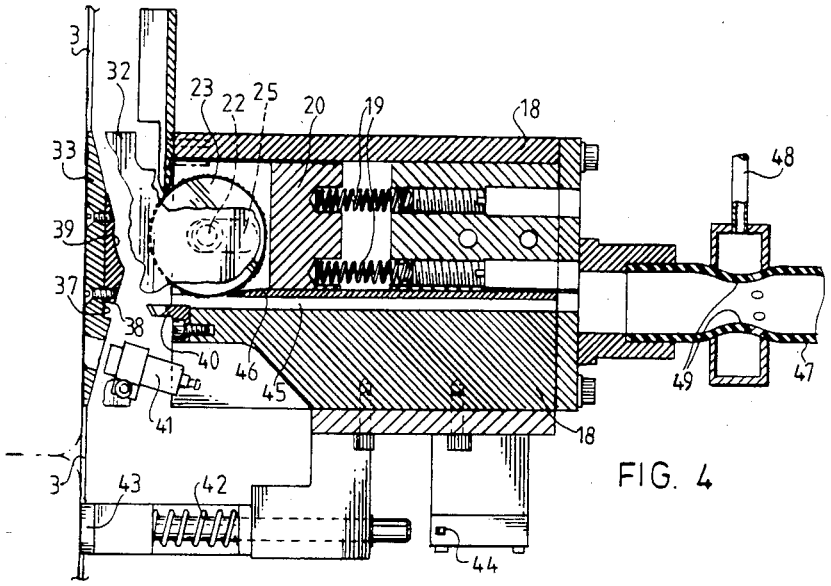
FIG. 4 is a horizontal sectional view taken on line IV—IV in FIG. 2.

The housing 18 of the cutting and discharge unit is provided on one of its two sides and at some distance beside the separating plate 33 with a feeler 43 loaded by a spring 42. If the stack has in each layer two or more juxtaposed objects, say loaded crates with rigid walls, the stack is so placed in the processing place in respect of the cutting and discharge apparatus, as to ensure that, when the cutting and discharge unit is moved towards the stack, the separating plate 33 hits one and the feeler 43 hits the adjacent other object (see FIGS. 4–7). The movement of the cutting and discharge unit towards the stack stops, when a micro switch 44 is operated by the feeler 43. Since for the operation of switch 44 the feeler 43 has to be moved for a predetermined distance of say 1–2 cm, the movement of the mentioned unit will come to a standstill only after the separating plate 33 has pushed the object in question for said distance to the left and thereby clearance between said object and the tape 3 has been created. This pushing away of the object in question takes place, when the separating plate 33 and the feeler are still situated in places above the tape to be cut through and discharged (FIG. 4).

It is observed that, when only one single object, for instance a box or limp material embraced by a strapping tape, has to be rid of its tape, care must be taken that said object can not be pushed away. In that case the clearance between the object and the tape is obtained by the fact that the limp wall of the object is slightly dented by the separating plate 33 before the feeler 43 operates the switch 44.

Figure 5:
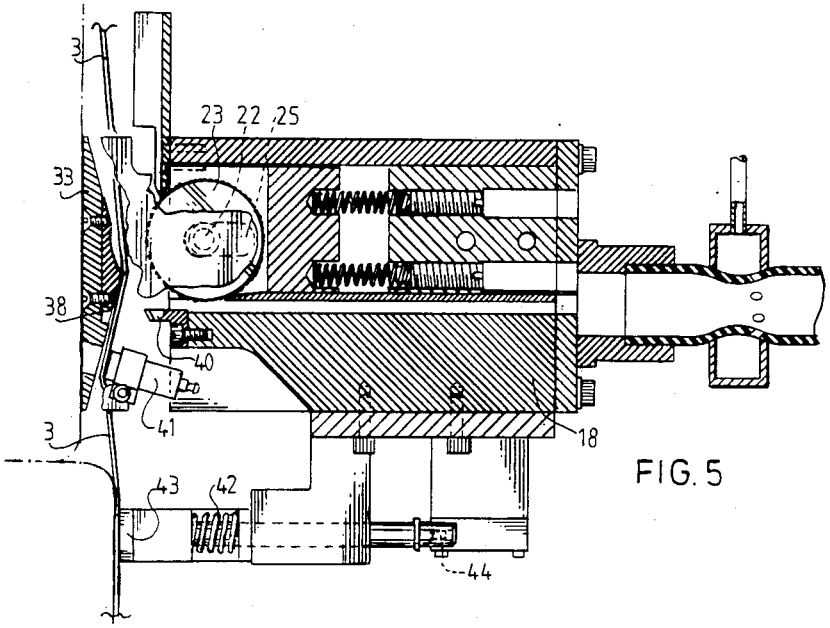
FIGS. 5, 6 and 7 are similar sectional views as that shown in FIG. 4 but of other working states of said unit.
Figure 6:
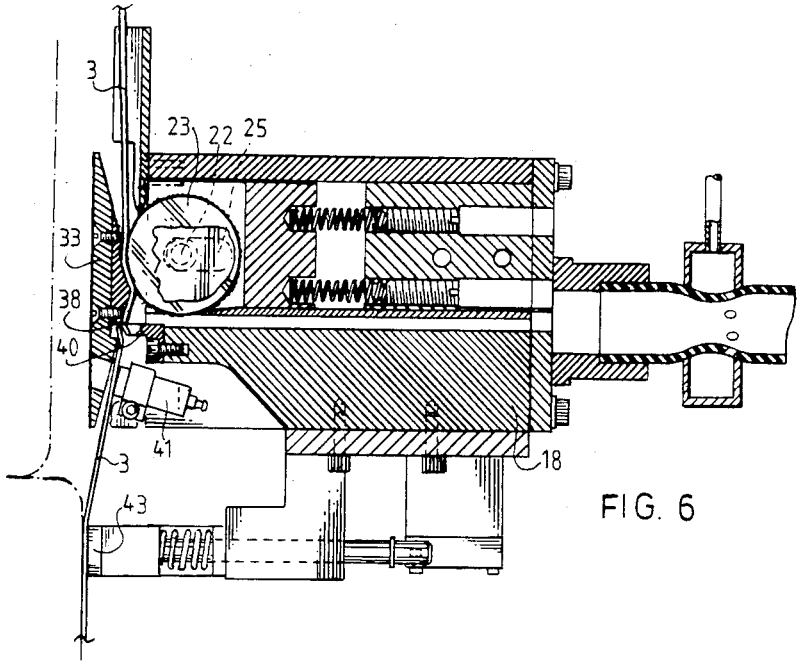
Figure 7:
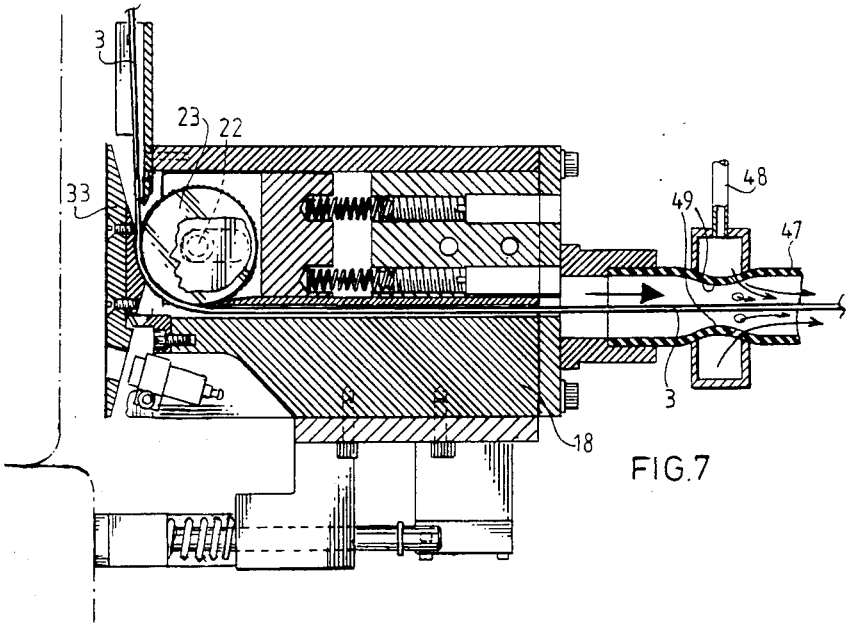

After the switch 44 has been operated the carrier 7 is moved further downwards together with the cutting and discharge unit in its position, when pushed to the left. As a result thereof the separating plate 33 and accessories is inserted into the space left between the object in question and the tape 3 and this movement of the carrier 7 is stopped, as soon as the tape has operated a micro switch (not shown) provided on the surface of the separating plate 33 facing the housing 18. Then the tape 3 extends in front of the pressure area 39 and over the left hand end of pneumatic switch 41 (FIG. 5). As has been said already, the cylinder 35 is controlled by the closing of the passages of said switch by the tape in such a manner, as to ensure that the slide 32 with the separating plate 33 and the feeler 43 is strongly forced to the right. The effect thereof is that the tape 3 is is first sheared through by the cutting edges 38 and 40 (FIG. 3 and thereupon the pressure area 39 is forced against the conveyor roller 23 which in the meantime has been rotated about its shaft 22 with great speed by the pneumatic motor 27 and said tape is then clamped between said pressure area and said roller with a force defined by the springs 19, so that the tape is gripped by said roller and let with its one end into a discharge passage 45 formed in the housing 18 and provided with a stripper 46. Thereafter the cut through tape is led through this passage into a discharge tube or hose 47 connected thereto and having a venturi-contraction 49 connected to a pressure conduit 48, so that the tape is drawn away. Thereupon, the tape removed from the stack of objects or the object may be discharged into a scrap box (FIG. 1).

Figure 3:
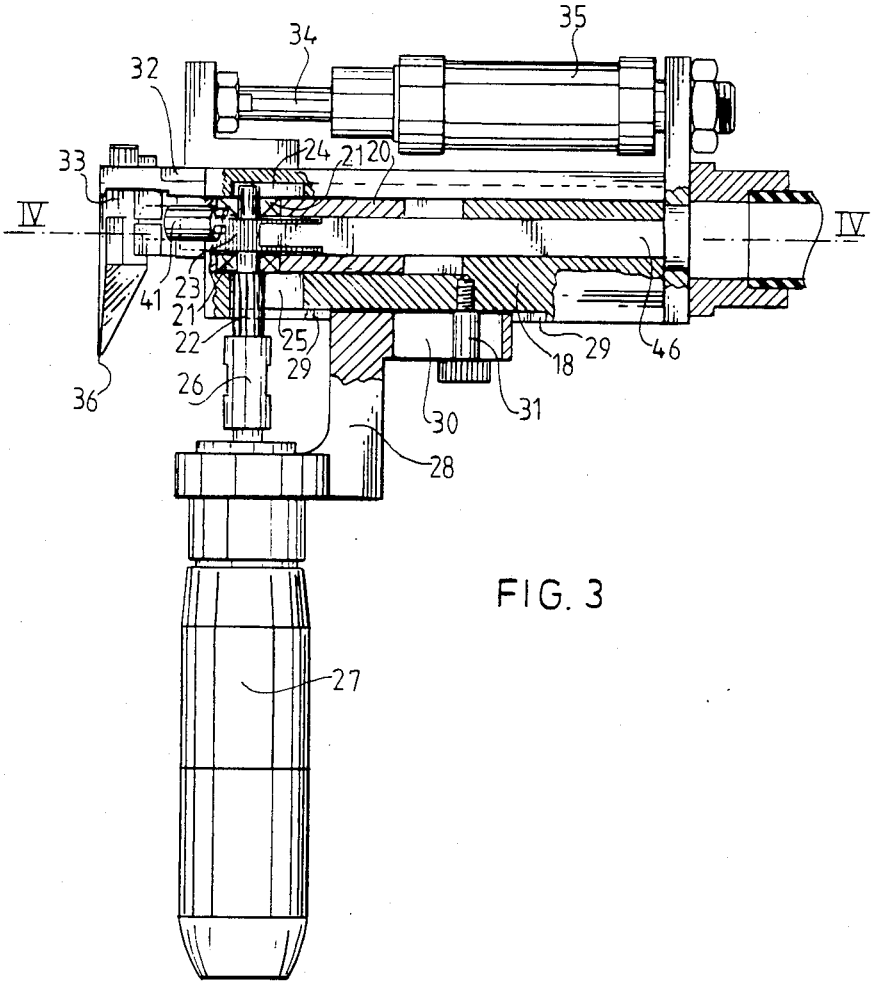
FIG. 3 shows on a larger scale partly an elevational view and partly a vertical sectional view of a cutting and discharge unit of said apparatus.

After the tape has been removed, the arm 13 with the cutting and discharge unit returns to its right hand end position shown in FIGS. 1,2 and 3. Should there be beneath the just removed tape an other tape the process described hereabove is repeated on a lower level. After the only tape or the last tape has been removed the objects or the stack of objects is moved away from the processing place in order to make place for the next object or stack of objects to be handled.

It will be obvious that the described apparatus may be used, when in a horizontal or other position instead of in upright position. An apparatus comprising a horizontal "guide column" with a horizontally movable carrier may advantageously be used to remove thread- or tape-like strapping elements from bales.

Furthermore it is observed that in many cases it is not necessary to create clearance between the object and the tape, before the separating plate is moved between the tape and the object. In such cases the feeler 43 operates the switch 44, as soon as the separating plate 33 has contacted the object.

What is claimed is:

1. The method of destrapping an object while it is in a stationary position, which comprises the steps of:

moving a cutting/clamping/feeding assembly along a first path perpendicular to the plane of the strap until it is in laterally offset but spaced, facing relation to the strap around the object;

moving the cutting/clamping/feeding assembly along a second path parallel to the plane of the strap toward the object until the cutting/clamping-/feeding assembly is laterally positioned with respect to the strap to be severed;

laterally moving the cutting/clamping/feeding assembly along the first path until it is in a straddling relation to the strap to be severed;

substantially simultaneously shearing the strap and resiliently clamping an end of the strap;

maintaining the resilient clamping of the strap while relatively rotating an element effecting the clamping until the strap has been fed to waste; and retracting the cutting/clamping/feeding assembly from the object along the first path.

2. The method as defined in claim 1 wherein the lateral movement of the cutting/clamping/feeding assembly into straddling relation to the strap deforms a portion of the strap into V-shaped configuration and including the step of automatically initiating the shearing and clamping step in response to the deformation of the strap.

3. Apparatus for destrapping an object having an encircling strap, which comprises the combination of a carrier and means mounting the carrier for movement back and forth along a path parallel to the object, a cutting/clamping/feeding assembly, means mounting said cutting/clamping/feeding assembly on the carrier for movement back and forth along a first path parallel to the plane of the encircling strap and for movement back and forth along a second path perpendicular to the plane of the strap, said cutting/clamping/feeding assembly including a housing movable with said carrier, a knife blade carried by the housing, a first slide mounted for relative movement with respect to the housing back and forth along the first path and including resilient means for urging the first slide away from the housing to a first position, a clamping/feeding roller carried by the first slide, a second slide mounted for relative movement with respect to the housing back and forth along the first path, a separating plate carried by the second slide and including a second knife blade, a roller carried by the first slide, means for traveling the second slide back and forth along the first path between a projected position in which the knife blades as well as the roller and the separating plate are in spaced apart relations and a retracted position in which the knife blades are overlapped and the roller resiliently sandwiches the tape between it and the separating plate, and means for rotating the roller while the strap is sandwiched between it and the separating plate.

4. Apparatus for destrapping an object having an encircling strap, which comprises the combination of a housing, a separating plate slidably carried by the housing and adapted to be positioned between the strap and the object, means for drawing the separating plate and the housing together, a roller resiliently mounted in the housing in facing relation to the separating plate and adapted to clamp the starp resiliently against the separating plate when the separating plate and the housing are drawn together, knife blade means cooperatively mounted on the housing and the separating plate for severing the tape when the roller resiliently clamps the tape between it and the separating plate, and means for rotating the roller while the tape is resiliently clamped.

5. Apparatus as defined in claim 4 wherein the roller is provided with a drive axle passing through the housing, the housing having a elongate slot therein receiving the drive axle to limit the movement of the roller with respect to the housing.

6. Apparatus as defined in claim 4 wherein the separating plate is wedge shaped.

7. Apparatus as defined in claim 4 wherein the housing includes a strap discharge passage extending substantially tangentially with respect to the roller.

8. Apparatus as defined in claim 4 including a feeler member mounted on the housing for engagement with the strap adjacent to the region thereof clamped between the roller and the separating plate so as to tent the strap over the separating plate as the separating plate moves away from the object, and switch means carried by the housing for engagement by the tented strap to actuate the means for drawing the separating plate and the housing together.

9. Apparatus as defined in claim 4 wherein the housing is provided with a tape discharge passage disposed substantially tangentially with respect to the roller and including suction means at that end of the passage remote from the roller for conveying tape to waste.

10. Apparatus as defined in claim 9 wherein the suction means is in the form of a venturi tube.

* * * * *